US007841142B2

(12) United States Patent
Towersey et al.

(10) Patent No.: US 7,841,142 B2
(45) Date of Patent: Nov. 30, 2010

(54) STACK-ON PANEL ASSEMBLY

(75) Inventors: Charles D. Towersey, Rockford, MI (US); Gordon F. Chapman, Butler, IN (US); Randall Lee Bixler, LaGrange, IN (US)

(73) Assignee: Steelcase Inc., Grand Rapids, MI (US)

( * ) Notice: Subject to any disclaimer, the term of this patent is extended or adjusted under 35 U.S.C. 154(b) by 822 days.

(21) Appl. No.: 11/603,480

(22) Filed: Nov. 22, 2006

(65) Prior Publication Data

US 2008/0115433 A1 May 22, 2008

(51) Int. Cl.
*E04H 1/00* (2006.01)

(52) U.S. Cl. ..... 52/239; 52/284

(58) Field of Classification Search ..... 52/36.1, 52/220.1, 239, 582.2, 284; 403/286, 291, 403/327, 397

See application file for complete search history.

(56) References Cited

U.S. PATENT DOCUMENTS 2,281,482 A * 4/1942 Crayton ..... 411/403
2,345,650 A * 4/1944 Attwood ..... 403/21
2,473,388 A * 6/1949 Rambo ..... 403/292
2,781,558 A * 2/1957 Peter ..... 52/578
3,034,609 A * 5/1962 Young ..... 52/241
3,180,459 A * 4/1965 Liskey ..... 52/474
3,592,289 A 7/1971 Aysta et al.
3,924,369 A * 12/1975 Guarino et al. ..... 52/126.3
4,060,294 A * 11/1977 Haworth et al. ..... 439/215
4,185,430 A * 1/1980 Gartung ..... 52/285.4
4,232,724 A 11/1980 Brown
4,251,968 A * 2/1981 Raith et al. ..... 52/481.2
4,344,475 A 8/1982 Frey
4,434,596 A 3/1984 McAteer et al.
4,443,986 A * 4/1984 Propst et al. ..... 52/239
4,448,003 A 5/1984 Hasbrouck
4,531,564 A * 7/1985 Hanna ..... 160/351
4,535,577 A 8/1985 Tenser et al.
4,545,168 A * 10/1985 Dalton, Jr. ..... 52/586.1
4,601,137 A * 7/1986 Bates ..... 52/63
4,625,880 A * 12/1986 Pym ..... 220/4.33
4,631,881 A * 12/1986 Charman ..... 52/220.7
4,644,993 A 2/1987 Cooper et al.
4,682,457 A * 7/1987 Spencer ..... 52/239
4,712,336 A 12/1987 Backer
4,891,922 A * 1/1990 Hozer et al. ..... 52/239
4,942,709 A 7/1990 Waldron
4,949,519 A * 8/1990 Jeffers ..... 52/239

(Continued)

*Primary Examiner*—Richard E Chilcot, Jr.
*Assistant Examiner*—James Ference
(74) *Attorney, Agent, or Firm*—Price, Heneveld, Cooper, DeWitt & Litton, LLP

(57) ABSTRACT

A stack-on panel assembly is supported on a base panel having tubular uprights disposed adjacent opposite sides thereof with open tops and a fastener end extending into an interior of the uprights. A stacker panel has a bottom portion abuttingly supported on a top portion of the base panel, a vertically extending slot along one side thereof, and a first latch member adjacent to the slot. A connector bracket has a lower portion received in the interior portion of the frame upright, and an aperture shaped to receive the fastener end to vertically locate the connector bracket relative to the base panel. The connector bracket is received in the slot to horizontally locate the stacker panel relative to the base panel, and has a second latch member selectively engaging the first latch member on the stacker panel.

49 Claims, 8 Drawing Sheets

U.S. PATENT DOCUMENTS 4,976,083 A * 12/1990 Menchetti ..... 52/489.1
4,986,038 A 1/1991 Backer
4,989,386 A * 2/1991 Collis ..... 52/584.1
5,036,638 A * 8/1991 Kurtz, Jr. ..... 52/284
5,056,577 A 10/1991 DeLong et al.
5,058,347 A 10/1991 Schuelke et al.
5,058,354 A * 10/1991 Menchetti ..... 52/489.1
5,058,355 A * 10/1991 Menchetti et al. ..... 52/489.1
5,069,263 A * 12/1991 Edwards ..... 160/135
5,070,666 A * 12/1991 Looman ..... 52/239
5,088,541 A 2/1992 Persing et al.
5,092,385 A 3/1992 Beaulieu
5,134,826 A 8/1992 Laroche et al.
5,155,955 A 10/1992 Ball et al.
5,175,969 A * 1/1993 Knauf et al. ..... 52/239
5,186,517 A * 2/1993 Gilmore et al. ..... 296/214
5,277,007 A 1/1994 Hellwig et al.
5,375,798 A * 12/1994 Hungerford, Jr. ..... 248/58
5,394,668 A 3/1995 Lim
5,431,210 A 7/1995 Nelson et al.
5,433,046 A 7/1995 MacQuarrie et al.
5,479,747 A * 1/1996 Wu ..... 52/220.7
5,490,357 A 2/1996 Lin
5,524,394 A * 6/1996 Szabo et al. ..... 52/36.1
5,579,621 A * 12/1996 Fang ..... 52/483.1
5,642,593 A * 7/1997 Shieh ..... 52/239
5,653,550 A * 8/1997 Mutz et al. ..... 403/329
5,737,893 A * 4/1998 Rossiter et al. ..... 52/481.2
5,802,789 A 9/1998 Goodman et al.
5,806,258 A 9/1998 Miedema et al.
5,816,001 A * 10/1998 Goodman et al. ..... 52/239
5,848,498 A * 12/1998 Szabo et al. ..... 52/36.1
5,852,904 A 12/1998 Yu et al.
5,867,955 A * 2/1999 Russell ..... 52/239
5,899,035 A * 5/1999 Waalkes et al. ..... 52/239
5,934,033 A * 8/1999 Matsuyama et al. ..... 52/235
5,950,386 A * 9/1999 Shipman et al. ..... 52/481.2
5,979,118 A 11/1999 Gortsema et al.
6,000,179 A 12/1999 Musculus et al.
6,000,180 A * 12/1999 Goodman et al. ..... 52/239
6,021,613 A * 2/2000 Reuter et al. ..... 52/241
6,029,831 A * 2/2000 Miller ..... 211/189
6,052,958 A 4/2000 Miedema et al.
6,058,667 A * 5/2000 MacDonald et al. ..... 52/239
6,067,762 A * 5/2000 Greer et al. ..... 52/220.7
6,079,173 A * 6/2000 Waalkes et al. ..... 52/239
6,082,065 A * 7/2000 Feldpausch ..... 52/239
6,088,980 A * 7/2000 Gulliver ..... 52/239
6,098,358 A * 8/2000 Waalkes et al. ..... 52/239
6,112,472 A * 9/2000 Van Dyk et al. ..... 52/36.1
6,141,926 A * 11/2000 Rossiter et al. ..... 52/239
6,158,179 A * 12/2000 Ackerly et al. ..... 52/220.7
6,167,664 B1 * 1/2001 Reuter et al. ..... 52/239
6,167,676 B1 1/2001 Shipman et al.
6,173,545 B1 * 1/2001 Feldpausch et al. ..... 52/239
6,244,002 B1 * 6/2001 Martin ..... 52/220.7
6,250,029 B1 6/2001 Jeffers et al.
6,250,032 B1 * 6/2001 Davis et al. ..... 52/239
6,260,324 B1 7/2001 Miedema et al.
6,276,102 B1 * 8/2001 Shipman et al. ..... 52/220.7
6,298,619 B1 * 10/2001 Davie ..... 52/293.3
6,301,846 B1 * 10/2001 Waalkes et al. ..... 52/239
6,330,773 B1 12/2001 MacDonald et al.
6,336,302 B1 * 1/2002 Brugman et al. ..... 52/483.1
6,349,516 B1 2/2002 Powell et al.
6,351,917 B1 3/2002 MacDonald et al.
6,389,773 B1 5/2002 Reuter et al.
6,393,783 B2 5/2002 Emaus et al.
6,394,689 B1 5/2002 Kuo
6,397,532 B1 6/2002 Shipman et al.
6,408,579 B1 6/2002 Anderson et al.
6,425,219 B1 7/2002 Barmak et al.
6,519,907 B1 * 2/2003 Weissinger ..... 52/582.2
6,543,164 B1 4/2003 Sperl et al.
6,658,805 B1 12/2003 Yu et al.
6,684,929 B2 2/2004 MacDonald et al.
6,754,998 B2 6/2004 Diffrient et al.
6,775,953 B2 8/2004 Burken et al.
6,807,776 B2 * 10/2004 Girdwood et al. ..... 52/36.1
6,817,149 B2 11/2004 Diffrient et al.
6,892,497 B2 * 5/2005 Moon et al. ..... 52/79.1
6,920,727 B2 7/2005 Yu et al.
6,928,785 B2 8/2005 Shipman et al.
6,941,716 B2 * 9/2005 Kottman ..... 52/489.1
6,951,085 B2 * 10/2005 Hodges et al. ..... 52/220.7
6,955,204 B1 * 10/2005 Gilbert et al. ..... 160/135
6,964,138 B2 * 11/2005 Carroll et al. ..... 52/239
7,051,482 B2 * 5/2006 MacDonald et al. ..... 52/239
7,453,047 B2 * 11/2008 Muehlebach ..... 174/481
7,461,484 B2 * 12/2008 Battey et al. ..... 52/220.7
7,581,357 B2 * 9/2009 Richardson et al. ..... 52/79.5
2001/0004099 A1 * 6/2001 Onishi ..... 248/49
2002/0069601 A1 6/2002 Hodges et al.
2002/0100236 A1 * 8/2002 Kuipers et al. ..... 52/239
2003/0154672 A1 8/2003 Spransy et al.
2004/0020137 A1 * 2/2004 Battey et al. ..... 52/36.1
2004/0093805 A1 5/2004 Underwood et al.
2004/0154756 A1 8/2004 MacDonald et al.
2005/0005527 A1 * 1/2005 Metcalf et al. ..... 52/36.1
2005/0196230 A1 * 9/2005 Dubon et al. ..... 403/327
2006/0059806 A1 3/2006 Gosling et al.
2006/0236625 A1 * 10/2006 MacDonald et al. ..... 52/239

* cited by examiner

STACK-ON PANEL ASSEMBLY

BACKGROUND OF THE INVENTION

The present invention relates to panel-based partition systems for offices and other similar environments, and in particular to a stack-on panel assembly therefor.

Partition panel systems have proven useful to convert large open floor spaces in buildings into useable office settings. These partition panel systems provide a cost-effective means for creating separate work environments for employees, and allow for easy and convenient rearrangement. Many of the partition panels used in these systems are structurally sound and are adapted to support various office furniture pieces including work surfaces, overhead cabinets, and shelves. In addition, the partition panels may have sound-absorbing capabilities, thus promoting a quiet and pleasant work environment.

In an effort to further increase the versatility of partition panel systems, stacker panels have been developed to modify the height of a partition panel for a given application. In the past, many stacking panels have proven difficult and/or time consuming to install and many fail to provide adequate routing pathways to accommodate power and/or communication lines. In addition, prior stacker panels frequently include a multitude of parts, which increases manufacturing and assembly costs. Accordingly, a stacker panel that can be securely yet easily mounted, has fewer parts, and otherwise minimizes the difficulties associated with prior stacker panels, is desired and would be considered advantageous.

SUMMARY OF THE INVENTION

One aspect of the present invention is a panel-based partition system of the type including at least one base panel having tubular frame uprights disposed adjacent opposite sides thereof with open tops and at least one fastener end extending into an interior portion of one of the frame uprights in combination with a stack-on panel assembly therefor. The stack-on panel assembly includes a stacker panel having a bottom portion abuttingly supported on a top portion of the base panel, and including at least one vertically extending slot disposed along one side thereof and a first latch member disposed adjacent to the slot. A connector bracket has a lower portion received in the interior portion of the one frame upright, and includes a horizontally extending aperture receiving the fastener end therein to vertically locate the connector bracket relative to the base panel. The connector bracket also includes an upper portion received in the slot in the stacker panel to horizontally locate the stacker panel relative to the base panel, and a second latch member selectively engaging the first latch member on the stacker panel to positively, yet detachably, connect the stacker panel on the base panel in a vertically stacked relationship.

Another aspect of the present invention is the improvement of a stack-on panel assembly for panel-based partition systems of the type including at least one base panel that has tubular frame uprights disposed adjacent opposite sides thereof with open tops and at least one fastener end extending into an interior portion of one of the frame uprights. The stack-on panel assembly includes a stacker panel having a bottom portion shaped for abutting support on a top portion of the base panel, and includes at least one vertically extending slot disposed along one side thereof, and a first latch member disposed adjacent to the slot. A connector bracket has a lower portion shaped for reception in the interior portion of the one frame upright, and includes a horizontally extending aperture shaped to receive the fastener end therein to vertically locate the connector bracket relative to the base panel. The connector bracket also has an upper portion received in the slot in the stacker panel to horizontally locate the stacker panel relative to the base panel, and a second latch member selectively engaging the first latch member on the stacker panel to positively, yet detachably, connect the stacker panel on the base panel in a vertically stacked relationship.

Yet another aspect of the present invention is a method for mounting a stacker panel on a base panel of the type having tubular frame uprights disposed adjacent opposite sides thereof with open tops and at least one fastener end extending into an interior portion of one of the frame uprights. The method includes fabricating a stacker panel having a bottom portion shaped for abutting support on a top portion of the base panel, and forming at least one vertically extending slot along one side of the bottom portion of the stacker panel. A first latch member is mounted on the stacker panel adjacent to the slot, and at least one connector bracket is fabricated with a lower portion shaped for reception in the interior portion of the one frame upright, and an upper portion shaped for reception in the slot in the stacker panel. A horizontally extending aperture is formed in the lower portion of the connector bracket and is shaped for reception over the fastener end in the one frame upright. A second latch member is mounted on the connector bracket at a location to selectively engage the first latch member on the stacker panel. The lower portion of the connector bracket is inserted into the one frame upright, and the aperture in the lower portion of the connector bracket is positioned over the fastener end in the one frame upright to vertically locate the connector bracket relative to the base panel. The slot in the stacker panel is vertically aligned over the upper portion of the connector bracket, and the stacker panel is lowered onto the base panel to a position in which the bottom portion of the stacker panel is abuttingly supported on the top portion of the base panel. The upper portion of the connector bracket is received in the slot in the stacker panel to horizontally locate the stacker panel relative to the base panel, and the first and second latch members are engaged to positively, yet detachably, mount the stacker panel on the base panel in a vertically stacked relationship.

Yet another aspect of the present invention is to provide a stack-on panel assembly that includes a base panel which securely, yet easily engages a stacker panel via a connector bracket. The base panel and stacker panel are vertically aligned in a stacked relationship to form a heightened partition wall that is easy to install, has a minimal part count, and does not require tools for installation. The stack-on panel assembly may be used in conjunction with stacker panels having an upholstery covering, or other coverings, as well as a clear panel made of glass or plastic. The stack-on panel assembly is efficient in use, economical to manufacture, capable of a long operating life, and particularly adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
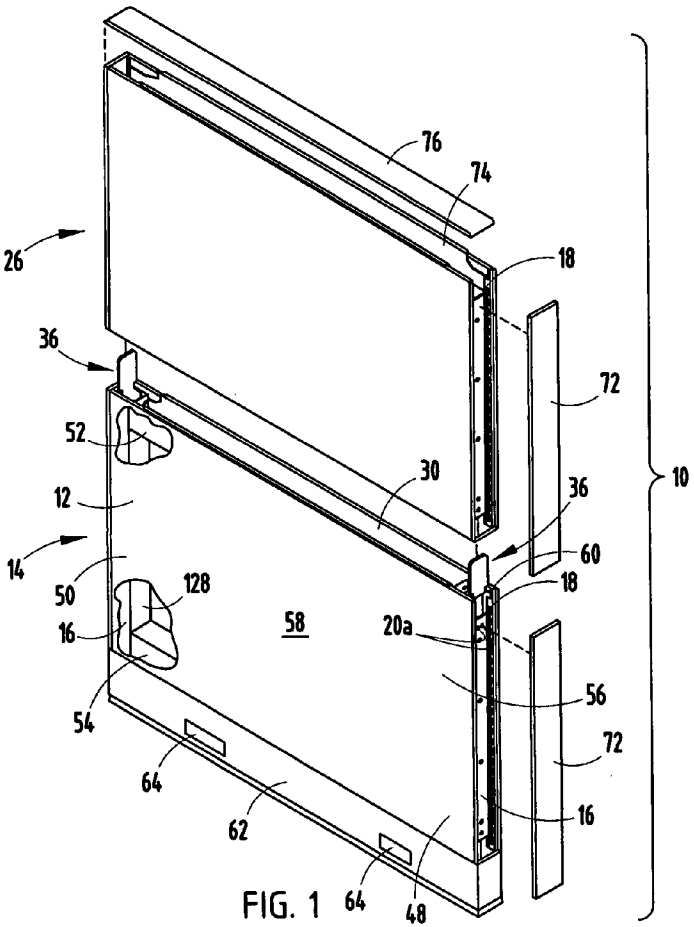
FIG. 1 is an exploded perspective view of a stack-on panel assembly embodying the present invention, shown positioned above an associated base panel.

For purposes of description herein the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
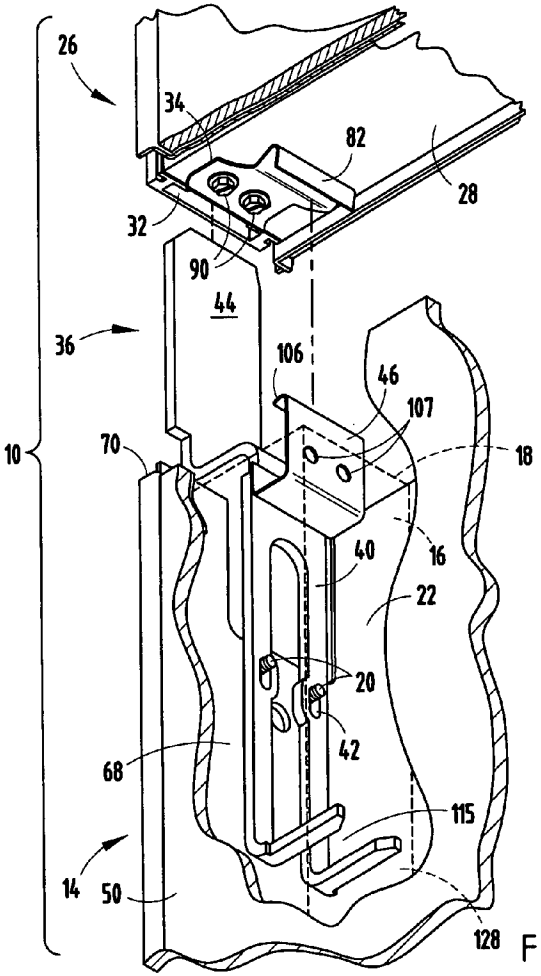
FIG. 2 is an enlarged partial perspective view of a connector bracket portion of the stack-on panel assembly shown installed in the base panel.

The reference numeral 10 shown in FIGS. 1 and 2 generally designates a stack-on panel assembly for panel-based partition systems 12 of the type including at least one base panel 14 that has tubular frame uprights 16 disposed adjacent opposite sides thereof with open tops 18 and at least one fastener end 20 extending into an interior portion 22 of one of the frame uprights 16. The stack-on panel assembly 10 includes a stacker panel 26 having a bottom portion 28 shaped for abutting support on a top portion 30 of base panel 14, and includes at least one vertically extending slot 32 disposed along one side thereof, and a first latch member 34 disposed adjacent to slot 32. A connector bracket 36 has a lower portion 40 received in the interior portion 22 of frame upright 16, and includes a horizontally extending aperture 42 shaped to receive fastener end 20 therein to vertically locate connector bracket 36 relative to base panel 14. Connector bracket 36 also has an upper portion 44 received in slot 32 in stacker panel 26 to horizontally locate stacker panel 26 relative to base panel 14, and a second latch member 46 selectively engaging first latch member 34 on stacker panel 26 to positively, yet detachably, connect stacker panel 26 on base panel 14 in a vertically stacked relationship.

Figure 27:
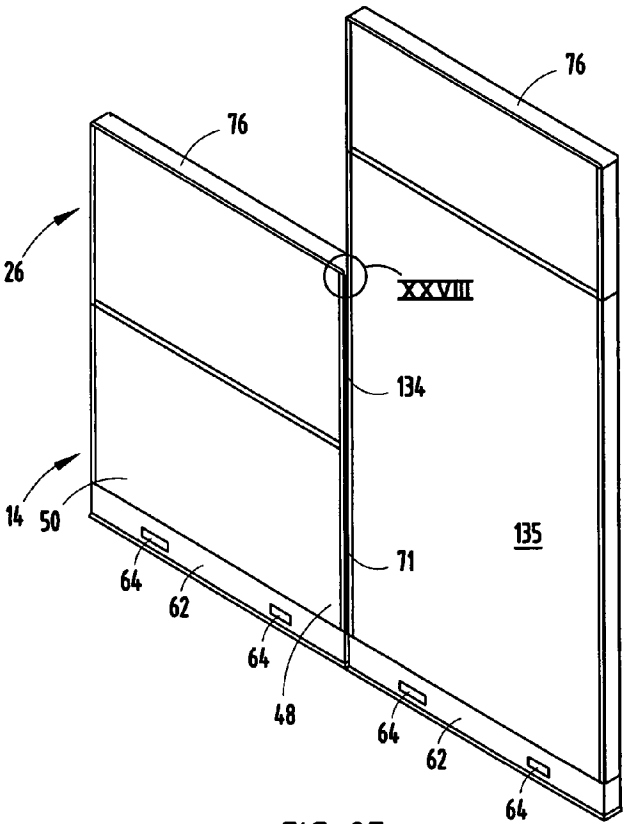
FIG. 27 is a perspective view of a stacker panel and base panel arrangement connected in-line with another partition panel arrangement.

Referring again to FIGS. 1 and 2, the particular base panel illustrated is a Series 9000 brand Steelcase partition panel. Tubular frame uprights 16 are located in the base panel 14 on first and second sides 48, 50 of the base panel 14 and are connected to top and bottom frame members 52, 54. Each tubular frame upright 16 is rectangular in cross section and has a rigid construction such that the tubular frame uprights 16 support the base panel 14. Removable cover panels or skins 56 are secured on front and rear sides 58, 60 of the base panel 14 to hide the inside of base panel 14 from view and to provide an aesthetic look to base panel 14. Base panel 14 also includes a base trim 62 that has cutouts 64 for routing utility lines 66 (FIG. 6) therethrough. The open tops 18 of tubular frame uprights 16 are located at the top of each tubular frame upright 16 adjacent to top frame member 52. The open tops 18 are large enough to wholly receive therein an associated connector bracket 36 when installing the stack-on assembly 10 in the manner described in greater detail below. Fastener ends 20 are located just below open tops 18 and protrude through an outside tubular frame wall 68 (FIG. 2) of the tubular frame upright 16 into a hollow interior portion 22 of tubular frame upright 16. The fasteners 20*a* associated with fastener ends 20 serve to secure an angle bracket 70 to tubular frame upright 16. Angle bracket 70 is typically connected to a corner post (not shown) or to an adjacent base panel using a hinge-like panel-to-panel connector 71 (FIG. 27).

As shown in FIG. 1, stacker panel 26 includes a rigid frame construction and is adapted to secure and maintain side trim pieces 72. Stacker panel 26 also has a top portion 74 adapted for receiving and detachably retaining a removable top trim cap 76 that may also be detachably retained on the top portion of base panel 14. The bottom portion 28 of stacker panel 26 is substantially planar for abutting top portion 30 of base panel 14. Vertically extending slots 32 are located on both sides of stacker panel 26, ascend upward along the opposite sides of stacker panel 26, and have a rectangular shape oriented parallel to the side edges of stacker panel 26. Vertically extending slots 32 open to the bottom portion 28 of stacker panel 26, and are disposed adjacent to latch member 34 (FIG. 2).

Figures 8, 9, 10, 11, 12, 13, 14, 15, 16:
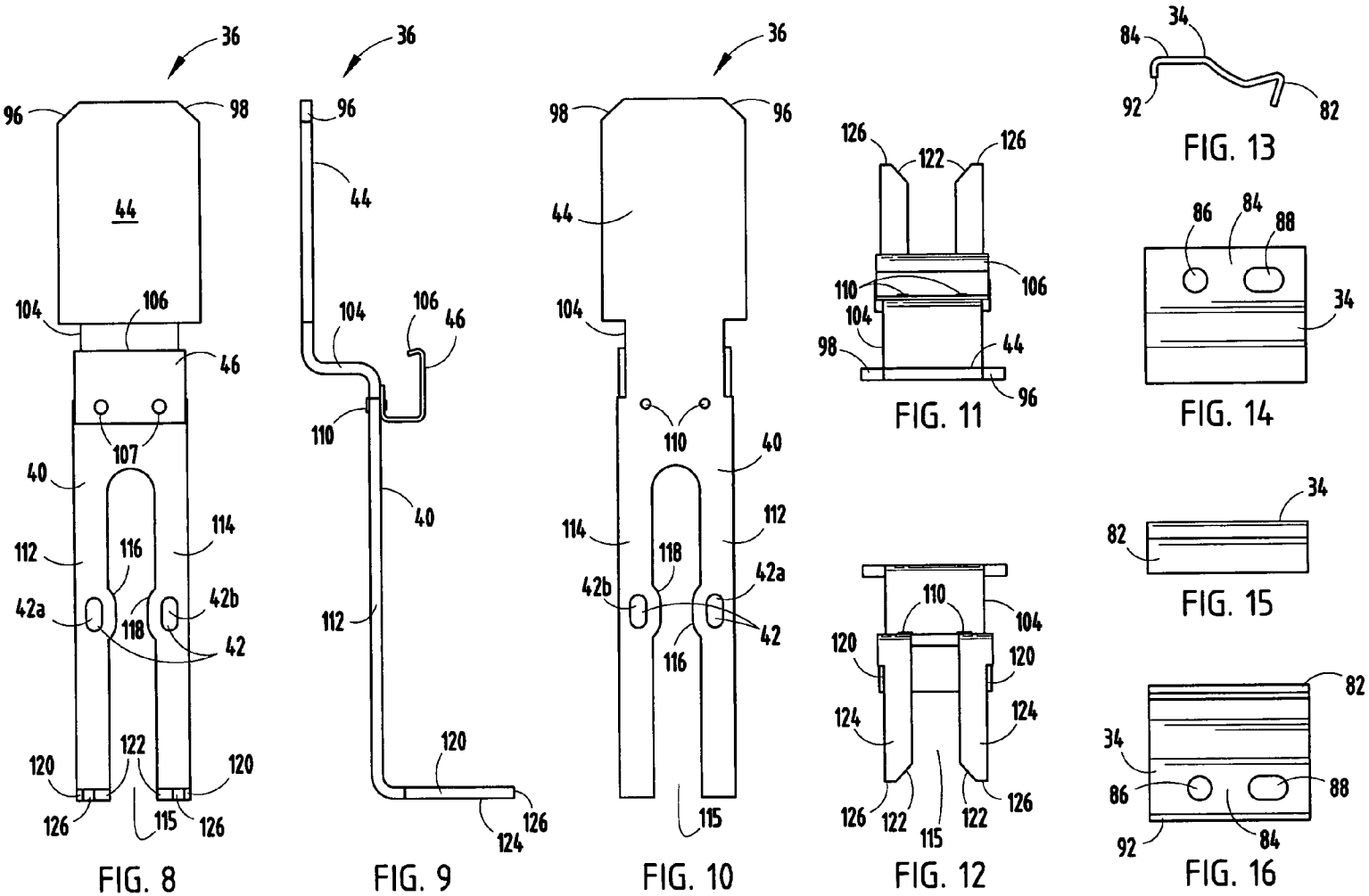
FIG. 8 is a front elevational view of the connector bracket.
FIG. 9 is a side elevational view of the connector bracket.
FIG. 10 is a rear elevational view of the connector bracket.
FIG. 11 is a top plan view of the connector bracket.
FIG. 12 is a bottom plan view of the connector bracket.
FIG. 13 is a side elevational view of a first spring clip portion of the present invention.
FIG. 14 is a top plan view of the spring clip shown in FIG. 13.
FIG. 15 is a front elevational view of the spring clip shown in FIG. 13.
FIG. 16 is a bottom plan view of the spring clip shown in FIG. 13.

Referring to FIG. 2, the illustrated first latch member 34 is in the form of a spring clip typically made of thin metal that is complementary with and engages latch member 46 on connector bracket 36. Stacker panel spring clip 34 opens laterally outwardly and has a generally V-shaped, side elevational configuration as shown in FIG. 13. In addition, stacker panel spring clip 34 includes a laterally outwardly extending catch end 82. FIGS. 14-16 show stacker panel spring clip 34 including an abutment portion 84 with fastening apertures 86, 88 adapted to receive mechanical fasteners 90. The fastening aperture 86 is relatively circular, while the adjacent aperture 88 is slightly elongated to allow stacker panel spring clip 34 to shift slightly during installation, as discussed below. The abutment portion 84 is integral with a downwardly turned lip portion 92, illustrated in FIG. 13, of stacker panel spring clip 34.

Referring again to FIG. 2, the illustrated latch member 46 on connector bracket 36 is also in the form of a spring clip that is complementary with and adapted to engage the stacker panel spring clip 34 on stacker panel 26. The stacker panel spring clip 34 is typically made of thin metal. Connector bracket 36 is also typically made from metal, but is much thicker and more rigid. The upper portion 44 of connector bracket 36 has a rectangular plan view shape and has an elevational view that is blade-shaped and configured for close reception in slot 32 in stacker panel 26. Also, the upper portion 44 of connector bracket 36 is slightly wider than the remainder of connector bracket 36, as best shown in FIGS. 8 and 10. Two tapered corners 96, 98 are located on the left and right top corners of connector bracket upper portion 44. A neck portion 104 attaches upper portion 44 of connector bracket 36 to lower portion 40. Neck 104 is narrower than both upper portion 44 and lower portion 40 of connector bracket 36. The illustrated connector bracket spring clip 46 has a generally U-shaped configuration, as shown in FIG. 9, which opens upwardly with a laterally inwardly extending catch end 106 that is designed to releasably engage the laterally outwardly extending catch end 82 on the first spring clip. The connector bracket spring clip 46 also includes holes 107 that extend through an interior side of connector bracket spring clip 46 and facilitate the connection of the connector bracket spring clip 46 to the connector bracket 36 by rivets 110 (FIG. 10).

Figure 6:
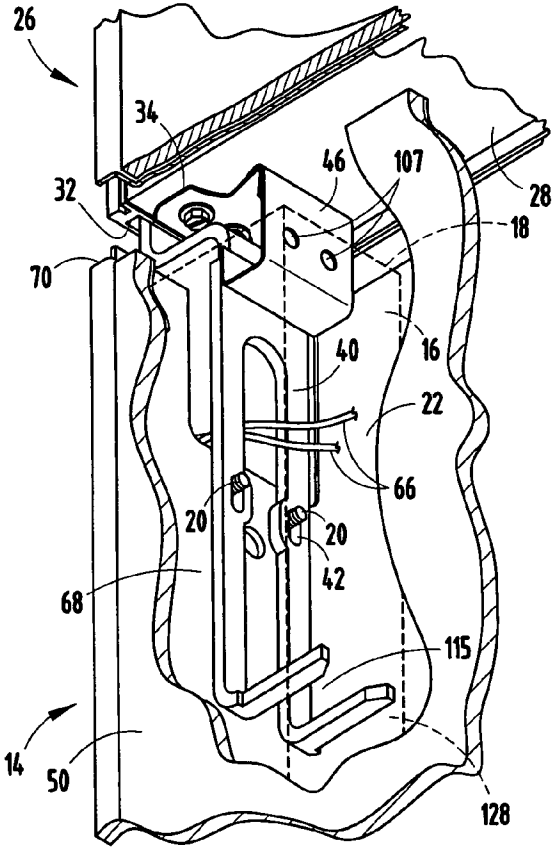
FIG. 6 is an enlarged partial perspective view of the stack-on panel assembly with the stacker panel shown fully installed on the base panel.

Referring to FIGS. 8-10, lower portion 40 of connector bracket 36 is fork-shaped and includes spaced apart prongs 112, 114 disposed adjacent opposite sides of lower portion 40. Lower portion 40 is configured for insertion into frame upright 16 at an angle, as will be discussed in further detail below. Prongs 112, 114 are configured so that a space 115 is created therebetween through which utilities 66, as shown in FIG. 6, may be routed. Also, horizontally extending apertures 42*a* and 42*b* extend through a medial portion of the prongs 112, 114 and are adapted to closely receive therein an associated fastener ends 20 to vertically locate connector bracket 36 relative to base panel 14. A bulbous area 116 on prong 112 projects inwardly toward the prong 114. Similarly, a bulbous area 118 on prong 114 projects inwardly toward prong 112. The bulbous areas 116, 118 maintain the structural rigidity of the prongs 112, 114, respectively, while also allowing the prongs 112, 114, to be as thin as possible to maximize the size of space 115, allowing for more utilities to be routed through space 115. Prongs 112, 114 have a generally L-shaped side elevational configuration adapted to vertically align connector bracket 36 within the tubular frame upright 16 of base panel 14. A bottom segment of prongs 112, 114 is substantially the same length as the internal width of each tubular frame upright 16, which serves to automatically align connector bracket 36 in its associated frame upright 16, as discussed in greater detail below.

Referring briefly to FIGS. 11 and 12, each of the prongs 112, 114 includes an outside indent 120 and an inside tapered edge 122 disposed on a distal end 124 of the prongs 112, 114. The distal end 124 of each prong 112, 114 also includes a contact surface 126 that is adapted to abut an internal frame wall 128 (FIG. 2) of frame upright 16 inside base panel 14. The transition from upper portion 44 to neck 104 and from neck 104 to lower portion 40 is made through smooth contoured ninety degree corners that facilitate easy installation and removal of connector bracket 36 in base panel 14.

Figure 21:
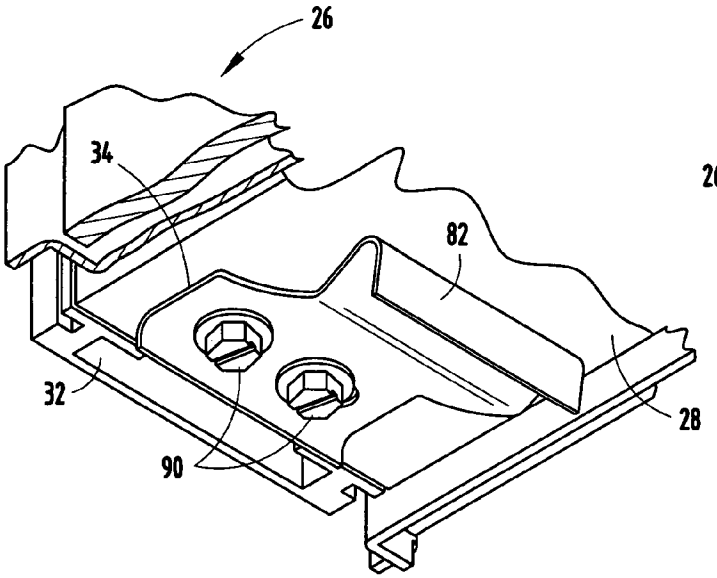
FIG. 21 is an enlarged perspective view of a spring clip portion of the present invention, fastened to the bottom of the stacker panel.

Referring to FIG. 21, to install the stack-on assembly 10 on an associated base panel 14, stacker panel spring clip 34 must first be attached to the bottom portion 28 of stacker panel 26. The abutment portion 84 of stacker panel spring clip 34 is attached to the bottom portion 28 of the stacker panel 26 by mechanical fasteners 90, preferably screws. The mechanical fasteners are secured between catch end 82 of stacker panel spring clip 34 and the vertically extending slot 32 of stacker panel 26. The V-shaped construction of stacker panel spring clip 34 allows slight bending so that the catch end 106 of connector bracket spring clip 46 can slide by stacker panel spring clip 34 when stacker panel 26 is being installed on base panel 14, as will be described in further detail below.

Figures 17, 18, 19, 20:
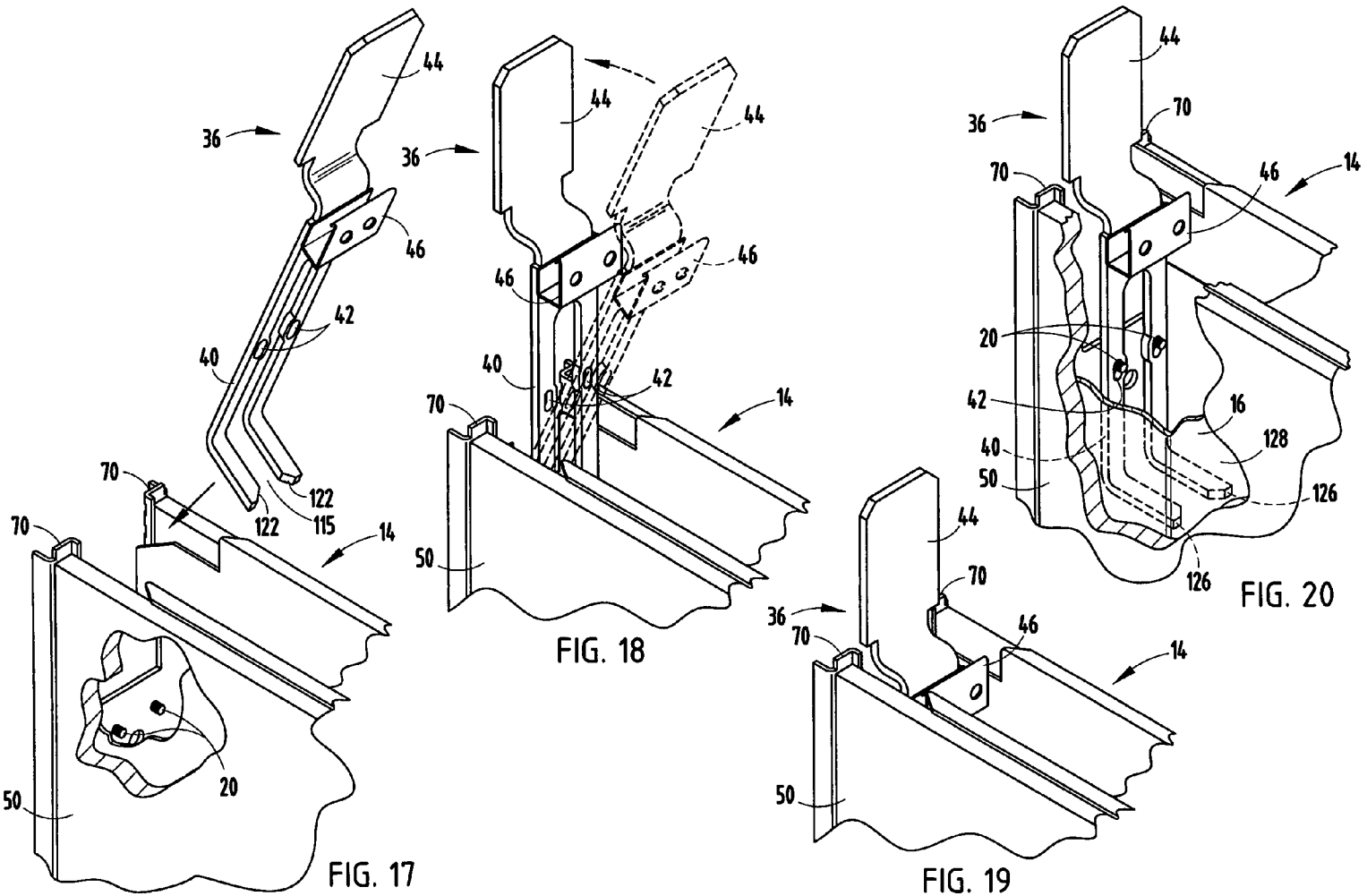
FIG. 17 is an enlarged partial perspective view of the connector bracket shown just prior to installation in the base panel.
FIG. 18 is an enlarged partial perspective view of the connector bracket shown partially installed in the base panel.
FIG. 19 is an enlarged partial perspective view of the connector bracket shown fully installed in the base panel.
FIG. 20 is an enlarged partial perspective view of the connector bracket in the fully installed position shown in FIG. 19.

Referring to FIGS. 17-20, after stacker panel spring clip 34 is fastened to the bottom portion 28 of stacker panel 26, a pair of connector brackets 36 must be installed in the base panel 14. In the example shown in FIGS. 17-20, each connector bracket 36 is inserted at an, angle into base panel 14 after top trim cap 76 (FIG. 1) has been removed. The angled insertion allows each connector bracket 36 to traverse past the ends 20 of fasteners 20*a* that extend into the interior portion 22 of frame upright 16. Accordingly, frame upright 16 does not interfere with the insertion of each prong 112, 114 into base panel 14. Connector brackets 36 are then shifted to a generally vertical orientation to position the horizontally extending apertures 42 over the fastener ends 20. Thus, the longitudinal extent of connector bracket 36 is at approximately a ninety degree angle from the planar extent of top portion 30 of base panel 14. Connector brackets 36 are lowered into base panel 14 until horizontally extending apertures 42 are aligned laterally with fastener ends 20. Fastener ends 20 are inserted into horizontally extending apertures 42 and, at the same time, contact surface 126 of prongs 112, 114 abuts internal frame wall 128 of frame upright 16 inside base panel 14. As mentioned above, the bottom segments of prongs 112, 114 are substantially the same length as the internal width of each tubular frame upright 16, which helps to align the connector bracket 36 in frame upright 16. Horizontally extending apertures 42 are somewhat larger than the width of the fastener ends 20, making insertion of fastener ends 20 into apertures 42 relatively easy. Once the fastener ends 20 are inserted into the horizontally extending apertures 42 and contact surface 126 abuts internal frame wall 128 of frame upright 16 as shown in FIG. 19, stacker panel 26 may be installed onto the upper portion 30 of base panel 14.

Figure 5:
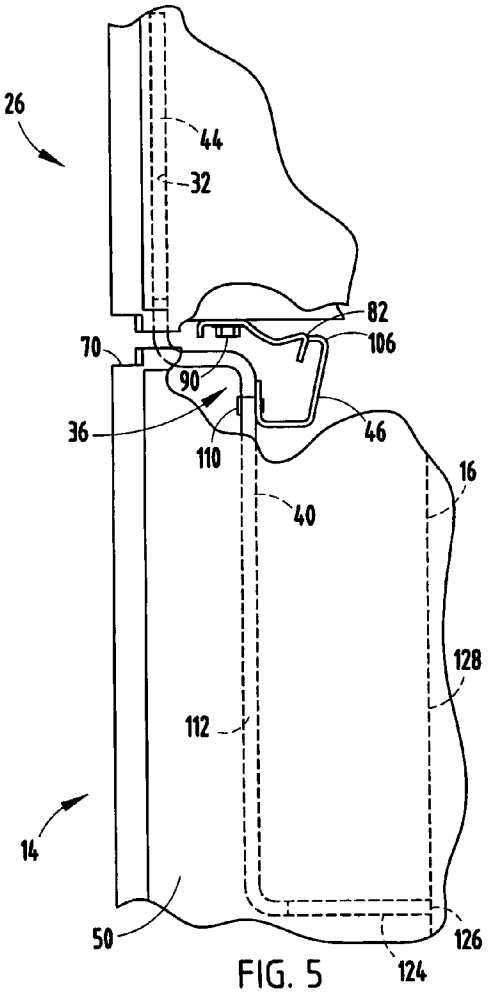
FIG. 5 is an enlarged partial front elevational view of the stack-on panel assembly with the stacker panel shown just prior to full engagement with the base panel.
Figure 4:
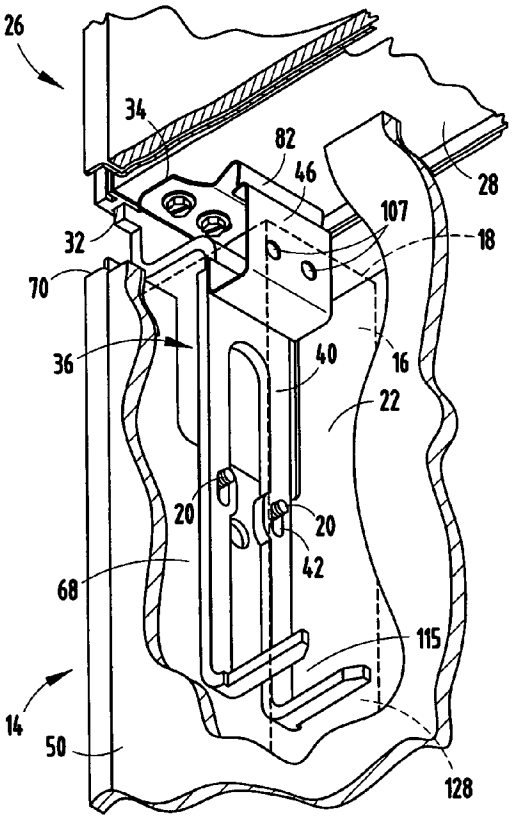
FIG. 4 is an enlarged partial perspective view of the stack-on panel assembly with the stacker panel shown in a nearly fully engaged position on the base panel.
Figure 3:
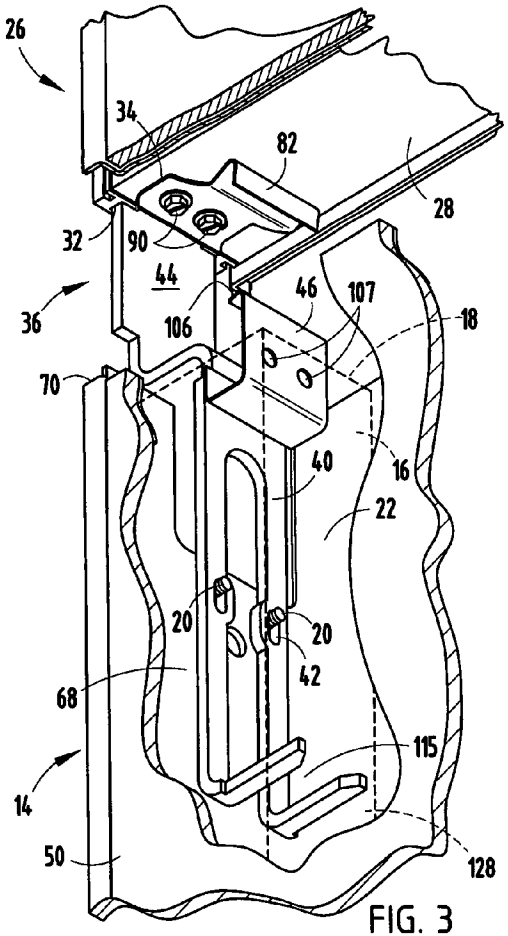
FIG. 3 is an enlarged partial perspective view of the stack-on panel assembly with a stacker panel portion thereof shown partially installed on the base panel.

Referring again to FIG. 2, once the connector bracket 36 is installed in the base panel 14, the upper portion 44 of connector bracket 36 is aligned with vertically extending slot 32 in stacker panel 26. As a result of this alignment, stacker panel 26 is aligned directly above base panel 14 and stacker panel spring clip 34 is aligned directly above connector bracket spring clip 46. Once aligned, the vertically extending slots 32 on stacker panel 26 are lowered over the upper portions 44 of connector brackets 36 as shown in FIG. 3. Stacker panel 26 is lowered until stacker panel spring clips 34 are in abutting engagement with connector bracket spring clips 46, as shown in FIG. 4. FIG. 5 shows stacker panel 26 urged downwardly by the installer with the assistance of gravity, so that laterally outwardly extending catch end 82 of stacker panel spring clip 34 pushes against laterally inwardly extending second catch end 106 of connector bracket spring clip 46, thereby forcing connector bracket spring clip 46 outwardly towards the interior of the base panel 14 and away from connector bracket 36.

Figure 7:
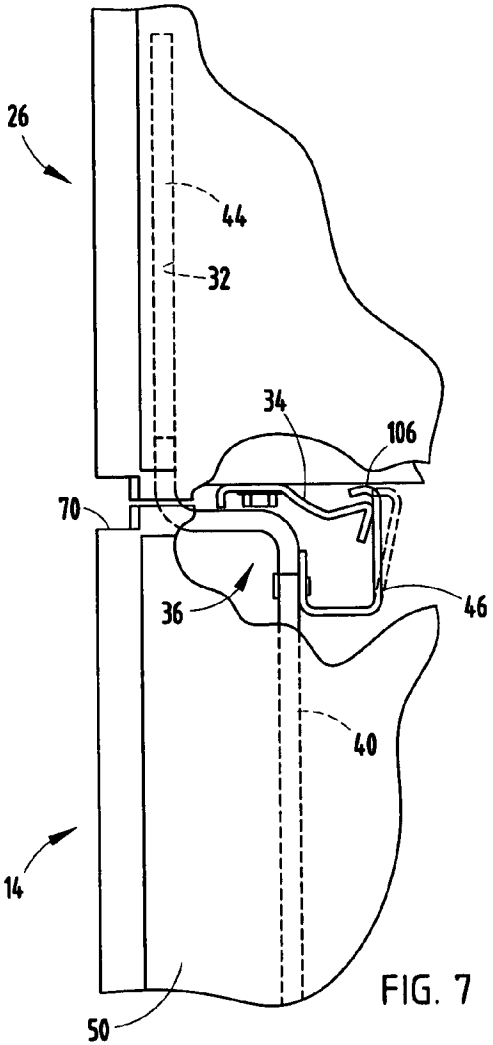
FIG. 7 is an enlarged partial front elevational view of the stack-on panel assembly with the stacker panel shown fully installed on the base panel.

Referring now to FIGS. 6 and 7, when the vertically extending slots 32 fully receive therein the upper portions 44 of connector brackets 36, catch end 106 of connector bracket 36 snaps over first end 82 of latch member 34 and back into a relatively vertical orientation (FIG. 7). When the catch end 106 abuts and releasably engages the catch end 82, the latch member 34 and the latch member 46 are positively engaged or locked together such that stacker panel 26 and base panel 14 cannot be inadvertently or accidentally separated.

Figure 23:
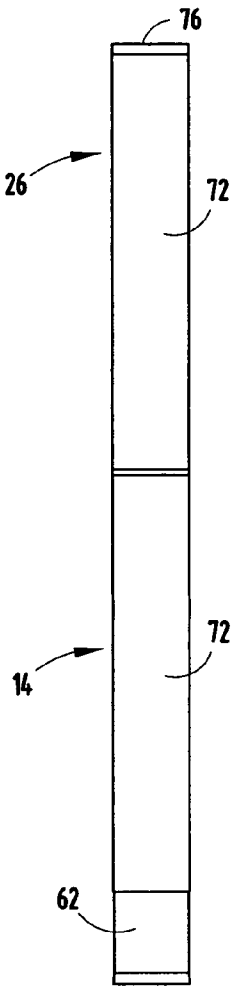
FIG. 23 is a side elevational view of the stacker panel and the base panel in the fully installed position.
Figure 22:
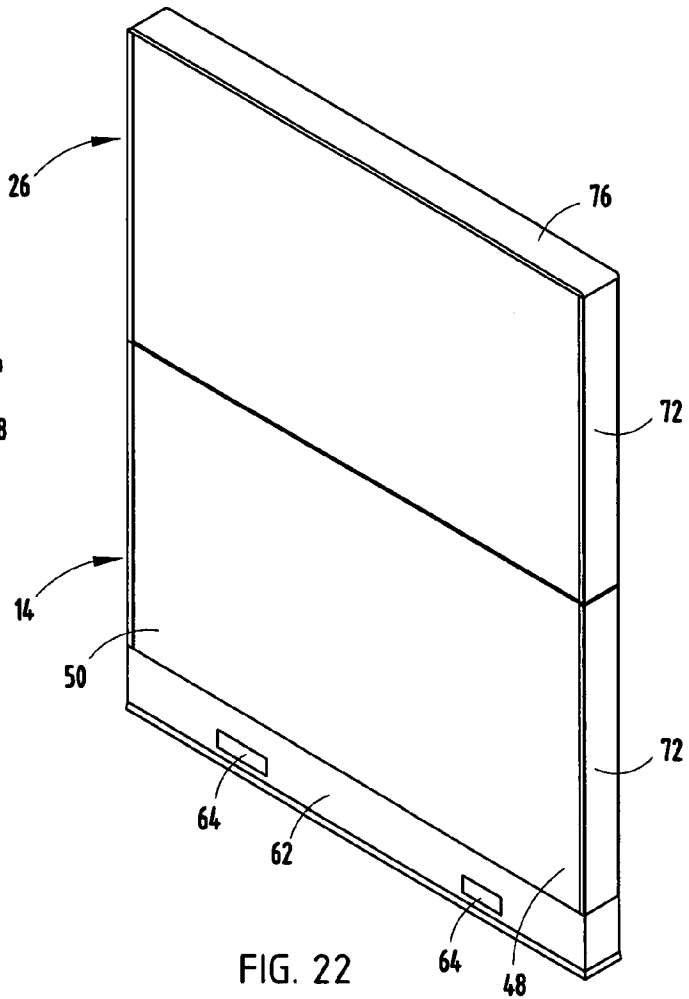
FIG. 22 is a perspective view of the stacker panel shown fully installed on the base panel.

FIGS. 22 and 23 illustrate base panel 14 properly installed on stacker panel 26, and further illustrate stacker panel 26 having a thickness and width which are generally commensurate with the thickness and width of base panel 14. Also, trim 62 has a width and thickness generally commensurate to the width and thickness of base panel 14 and stacker panel 26. It is generally contemplated that the width and thickness of the base panel 14 could vary from the thickness of stacker panel 26. Similarly, the trim 62 could have a width and thickness greater or less than the width and thickness of the base panel 14 or stacker panel 26.

Figure 26:
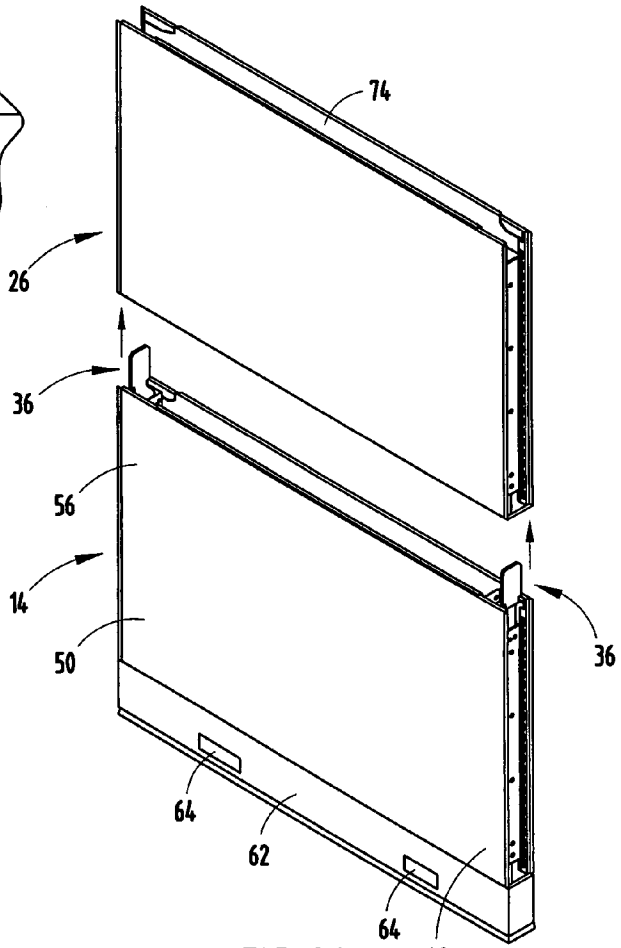
FIG. 26 is a perspective view of the stacker panel being removed from the base panel.
Figure 25:
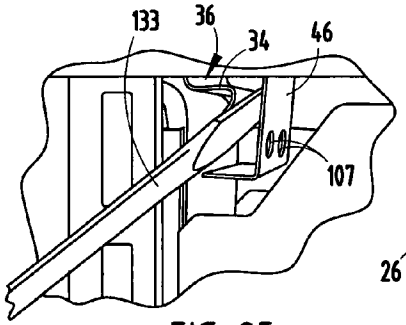
FIG. 25 is an enlarged partial view of the spring clip on the stacker panel being separated from the mating spring clip on the connector bracket.
Figure 24:
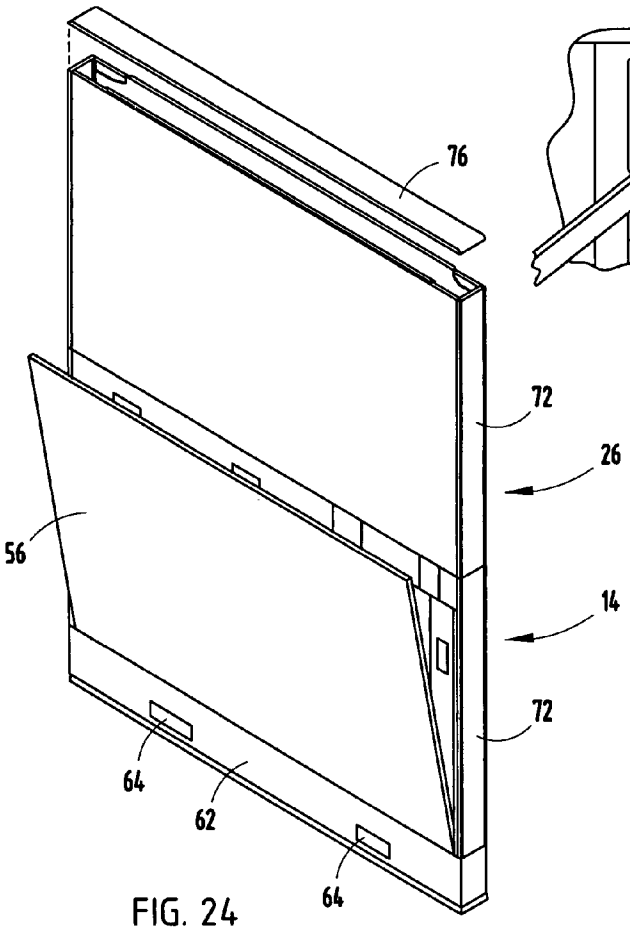
FIG. 24 is a perspective view of the stacker panel and base panel arrangement shown in FIG. 23, with a top trim cap portion of the stacker panel removed and a cover panel portion of the base panel tilted outward.

Referring now to FIGS. 24-26, removable top trim cap 76, which typically is originally secured on base panel 14, may be removed for use on stacker panel 26. Stacker panel 26 has a top portion 74 (FIG. 26) configured to receive and detachably retain top trim cap 76 thereon. To remove stacker panel 26 from base panel 14, one of the cover panels 56 of base panel 14 is removed so that the engagement between stacker panel spring clip 34 and connector bracket spring clip 46 is visible. A rigid elongate tool, such as the illustrated screwdriver 133, is inserted between stacker panel spring clip 34 and connector bracket spring clip 46 and maneuvered such that stacker panel spring clip 34 and connector bracket spring clip 46 are separated or spread apart to the unlocked or disengaged position shown in FIG. 25. When stacker panel spring clip 34 and connector bracket spring clip 46 on both sides of stacker panel 26 are disengaged, first catch end 82 clears second catch end 106 so that stacker panel 26 may be lifted and removed from base panel 14 in the manner shown in FIG. 26.

Figure 28:
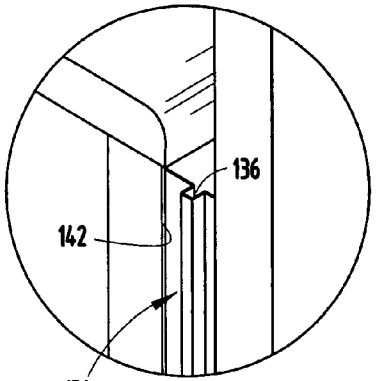
FIG. 28 is an enlarged perspective view of a trim portion of the stack-on panel assembly, taken from the circle XXVIII of FIG. 27.
Figure 29:
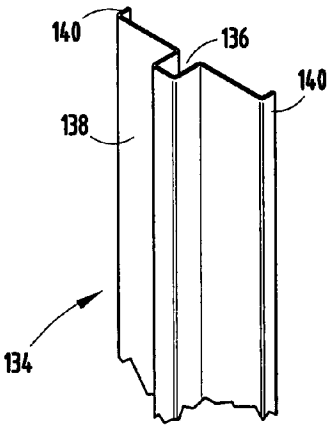
FIG. 29 is an enlarged partial perspective view of the trim shown in FIG. 28.

As shown in FIGS. 27-29, stacker panel 26 also includes a trim strip 134 that has an appearance similar to that of the hinge-like panel-to-panel connector 71 when installed. The trim strip 134 is connected with one side of stacker panel 26 for change-of-height panel configurations and assists in aligning stacker panel 26 with an adjacent panel 135 and also minimizing wobble in stacker panel 26. Trim strip 134 includes a center groove 136 that is flanked on either side by a planar extension 138. Each planar extension 138 includes an upturned edge 140. Trim strip 134 is adapted to engage opposing channels 142 formed at side corners of stacker panel 26 and base panel 14.

Figure 30:
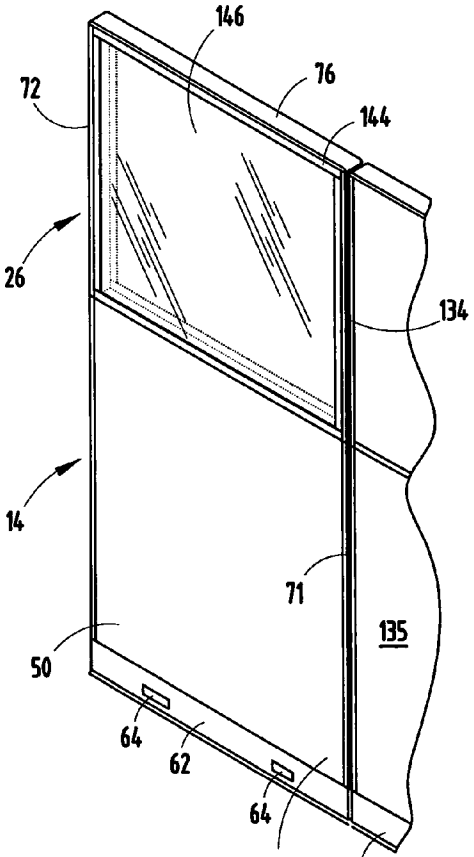
FIG. 30 is a perspective view of a stacker panel with a light-transmitting panel shown installed on the base panel.

Referring now to FIG. 30, stacker panel 26 may include a marginal frame 144 with a light-transmitting panel 146 mounted therein instead of traditional side covers that do not transmit light. Stacker panel 26 provides light into a work area while helping to minimize external noise flowing into the work area.

It is to be understood that variations and modifications can be made to the aforementioned structure without departing from the concepts of the present invention, and further it is to be understood that such concepts are intended to be covered by the following claims unless these claims by their language expressly state otherwise.

The invention claimed is:

1. A stack-on panel assembly for panel-based partition systems of the type including at least one base panel having a rigid rectangular interior frame with tubular frame uprights disposed adjacent opposite sides thereof with open tops and at least one fastener end extending into an interior portion of one of the frame uprights, comprising:

a stacker panel having a rigid rectangular configuration with a bottom portion thereof abuttingly supported on a top portion of the base panel, and including at least one vertically extending slot disposed along one side thereof, and a first spring latch member disposed adjacent to said slot;

at least one connector bracket having:

a lower portion thereof received in the interior portion of the one frame upright, and including a horizontally extending aperture receiving the fastener end therein vertically locating said connector bracket relative to the base panel;

an upper portion thereof received in said slot in said stacker panel horizontally locating said stacker panel relative to the base panel; and a second spring latch member located adjacent to said upper portion of said connector bracket and configured for selectively engaging said first latch member on said stacker panel, whereby in an installed position, said first spring latch member and second spring latch member engage and define a snap lock that positively, yet detachably, connects said stacker panel on the base panel in a vertically stacked relationship.

2. A stack-on panel assembly as set forth in claim 1, wherein:

said lower portion of said connector bracket is fork-shaped with two spaced apart prongs disposed adjacent opposite sides thereof.

3. A stack-on panel assembly as set forth in claim 2, wherein:

said prongs define therebetween a space shaped to route utilities therethrough.

4. A stack-on panel assembly as set forth in claim 3, wherein:

said prongs have a generally L-shaped side elevational configuration to vertically align said connector bracket within the one frame upright.

5. A stack-on panel assembly as set forth in claim 4, wherein:

said lower portion of said connector bracket is configured for insertion into the one frame upright in an angled orientation, and subsequently shifted to a generally vertical orientation to position said aperture over the fastener end.

6. A stack-on panel assembly as set forth in claim 5, wherein:

said first spring latch member comprises a first spring clip connected with said bottom portion of said stacker panel.

7. A stack-on panel assembly as set forth in claim 6, wherein:

said second spring latch member comprises a second spring clip connected with said connector bracket, and shaped to abut and releasably engage said first spring clip.

8. A stack-on panel assembly as set forth in claim 7, wherein:

said aperture extends through said lower portion of said connector bracket.

9. A stack-on panel assembly as set forth in claim 8, wherein:

said aperture extends through a medial portion of one of said prongs.

10. A stack-on panel assembly as set forth in claim 9, wherein:

said aperture is shaped for close reception on the fastener end.

11. A stack-on panel assembly as set forth in claim 10, wherein:

said upper portion of said connector bracket is blade-shaped, and configured for close reception in said slot in said stacker panel.

12. A stack-on panel assembly as set forth in claim 11, wherein:

said first spring clip has a generally V-shaped configuration which opens laterally outwardly with a laterally outwardly extending first catch end.

13. A stack-on panel assembly as set forth in claim 12, wherein:

said second spring clip has a generally U-shaped configuration which opens upwardly with a laterally inwardly extending second catch end that releasably engages said first catch end on said first spring clip.

14. A stack-on panel assembly as set forth in claim 13, including:

a trim strip connected with one side of said stacker panel for change-of-height panel configurations.

15. A stack-on panel assembly as set forth in claim 1, wherein:

said lower portion of said connector bracket includes a space shaped to route utilities therethrough.

16. A stack-on panel assembly as set forth in claim 1, wherein:

said lower portion of said connector bracket has a generally L-shaped side elevational configuration to vertically align said connector bracket within the one frame upright.

17. A stack-on panel assembly as set forth in claim 1, wherein:

said lower portion of said connector bracket is configured for insertion into the one frame upright in an angled orientation, and subsequently shifted to a generally vertical orientation to position said aperture over the fastener end.

18. A stack-on panel assembly as set forth in claim 1, wherein:

said first spring latch member comprises a first spring clip connected with said bottom portion of said stacker panel; and said second spring latch member comprises a second spring clip connected with said connector bracket, and shaped to abut and releasably engage said first spring clip.

19. A stack-on panel assembly as set forth in claim 1, wherein:

said aperture is shaped for close reception on the fastener end.

20. A stack-on panel assembly as set forth in claim 1, wherein:

said upper portion of said connector bracket is blade-shaped, and configured for close reception in said slot in said stacker panel.

21. A panel-based partition system, comprising:

at least one base panel having a rigid rectangular interior frame with tubular frame uprights disposed adjacent opposite sides thereof with open tops and at least one fastener end extending into an interior portion of one of said frame uprights; and a stack-on panel assembly, including:

a stacker panel having a rigid rectangular configuration with a bottom portion thereof abuttingly supported on a top portion of said base panel, at least one vertically extending slot disposed along one side thereof, and a first spring latch member disposed adjacent to said slot;

at least one connector bracket having:

a lower portion thereof received in the interior portion of said one frame upright, and including a horizontally extending aperture receiving said fastener end therein vertically locating said connector bracket relative to said base panel;

an upper portion thereof received in said slot in said stacker panel horizontally locating said stacker panel relative to said base panel; and a second spring latch member located adjacent to said upper portion of said connector bracket and configured for selectively engaging said first spring latch member on said stacker panel, whereby in an installed position, said first spring latch member and said second spring latch member engage and define a snap lock that positively, yet detachably, connects said stacker panel on said base panel in a vertically stacked relationship.

22. A partition system as set forth in claim 21, wherein:

said lower portion of said connector bracket is fork-shaped with two spaced apart prongs disposed adjacent opposite sides thereof.

23. A partition system as set forth in claim 22, wherein:

said prongs define therebetween a space shaped to route utilities therethrough.

24. A partition system as set forth in claim 23, wherein:

said prongs have a generally L-shaped side elevational configuration to vertically align said connector bracket within said one frame upright.

25. A partition system as set forth in claim 24, wherein:

said lower portion of said connector bracket is configured for insertion into said one frame upright in an angled orientation, and subsequently shifted to a generally vertical orientation to position said aperture over said fastener end.

26. A partition system as set forth in claim 25, wherein:

said first spring latch member comprises a first spring clip connected with said bottom portion of said stacker panel.

27. A partition system as set forth in claim 26, wherein:
said second spring latch member comprises a second spring clip connected with said connector bracket, and shaped to abut and releasably engage said first spring clip.

28. A partition system as set forth in claim 27, wherein:
said aperture extends through said lower portion of said connector bracket.

29. A partition system as set forth in claim 28, wherein:
said aperture extends through a medial portion of one of said prongs.

30. A partition system as set forth in claim 29, wherein:
said aperture is shaped for close reception on said fastener end.

31. A partition system as set forth in claim 30, wherein:
said upper portion of said connector bracket is blade-shaped, and configured for close reception in said slot in said stacker panel.

32. A partition system as set forth in claim 31, wherein:
said base panel includes a pair of said fastener ends extending into said interior portion of both of said frame uprights.

33. A partition system as set forth in claim 32, wherein:
said stack-on panel assembly includes a pair of said connector brackets positioned adjacent said opposite sides of said base panel; and
said stacker panel includes a pair of said slots adjacent opposite sides thereof in which said upper portions of said connector brackets are closely received.

34. A partition system as set forth in claim 33, wherein:
said connector bracket includes one of said apertures in each of said prongs.

35. A partition system as set forth in claim 34, wherein:
said first spring clip has a generally V-shaped configuration which opens laterally outwardly with a laterally outwardly extending first catch end.

36. A partition system as set forth in claim 35, wherein:
said second spring clip has a generally U-shaped configuration which opens upwardly with a laterally inwardly extending second catch end that releasably engages said first catch end on said first spring clip.

37. A partition system as set forth in claim 36, wherein:
said stacker panel has a thickness which is generally commensurate with the thickness of said base panel.

38. A partition system as set forth in claim 37, wherein:
said stacker panel has a width which is generally commensurate with the width of said base panel.

39. A partition system as set forth in claim 38, wherein:
said base panel includes a removable top trim cap; and
said stacker panel has a top configured to receive and detachably retain said top trim cap thereon.

40. A partition system as set forth in claim 39, including:
a trim strip connected with one side of said stacker panel for change-of-height panel configurations.

41. A partition system as set forth in claim 21, wherein:
said stacker panel includes a marginal frame with a light-transmitting panel mounted therein.

42. A partition system as set forth in claim 21, wherein:
said lower portion of said connector bracket includes a space shaped to route utilities therethrough.

43. A partition system as set forth in claim 21, wherein:
said lower portion of said connector bracket has a generally L-shaped side elevational configuration to vertically align said connector bracket within said one frame upright.

44. A partition system as set forth in claim 21, wherein:
said lower portion of said connector bracket is configured for insertion into said one frame upright in an angled orientation, and subsequently shifted to a generally vertical orientation to position said aperture over said fastener end.

45. A partition system as set forth in claim 21, wherein:
said aperture extends through said lower portion of said connector bracket; and
said upper portion of said connector bracket is blade-shaped.

46. A partition system as set forth in claim 21, wherein:
said first spring latch member comprises a first spring clip connected with said bottom portion of said stacker panel and having a generally V-shaped configuration which opens laterally outwardly with a laterally outwardly extending first catch end; and
said second spring latch member comprises a second spring clip having a generally U-shaped configuration which opens upwardly with a laterally inwardly extending second catch end that releasably engages said first catch end on said first spring clip.

47. A partition system as set forth in claim 21, wherein:
said stacker panel has a thickness which is generally commensurate with the thickness of said base panel; and
said stacker panel has a width which is generally commensurate with the width of said base panel.

48. A partition system as set forth in claim 21, wherein:
said base panel includes a removable top trim cap; and
said stacker panel has a top configured to receive and detachably retain said top trim cap thereon.

49. A partition system as set forth in claim 21, including:
a trim strip connected with one side of said stacker panel for change-of-height panel configurations.

* * * * *